US005742887A

United States Patent [19]

Suzuki et al.

[11] Patent Number: 5,742,887

[45] Date of Patent: Apr. 21, 1998

[54] COLOR IMAGE OUTPUT APPARATUS FOR RECORDING A COLOR IMAGE HAVING INDEPENDENTLY MOVABLE COLOR IMAGE FORMING UNITS

[75] Inventors: Makoto Suzuki, Nagoya; Masaki Takatsugi, Toyohashi; Naoto Iwao, Nagoya, all of Japan

[73] Assignee: Brother Kogyo Kabushiki Kaisha, Aichi-ken, Japan

[21] Appl. No.: 742,829

[22] Filed: Oct. 31, 1996

[30] Foreign Application Priority Data

Nov. 15, 1995 [JP] Japan ..... 7-296787

[51] Int. Cl.[6] ..... G03G 15/01; G03G 15/16

[52] U.S. Cl. ..... 399/301; 399/302

[58] Field of Search ..... 399/299, 301, 399/302; 347/116, 117

[56] References Cited

FOREIGN PATENT DOCUMENTS 62-129871 6/1987 Japan .

*Primary Examiner*—Joan H. Pendegrass

*Attorney, Agent, or Firm*—Oliff & Berridge, PLC

[57] ABSTRACT

A color image output apparatus having a plurality of single color image forming units for different colors arrayed in-line. Each single color image forming unit includes a toner box, a photosensitive drum and a transfer roller, and provides a position adjusting unit for moving its image transfer portion in a direction toward and away from or normal to a running direction of an intermediate image transfer belt. Each position adjusting unit includes a motor fixed to the toner box, a thread fixed to an output shaft of the motor, an arm fixed to a main frame and engageable with the thread. Each rotation of each motor provides independent movement of each toner box of each single color image forming unit. This movement provides inclination of the intermediate image transfer belt between neighboring image transfer portions.

16 Claims, 4 Drawing Sheets

COLOR IMAGE OUTPUT APPARATUS FOR RECORDING A COLOR IMAGE HAVING INDEPENDENTLY MOVABLE COLOR IMAGE FORMING UNITS

BACKGROUND OF THE INVENTION

The present invention relates to a color image output apparatus having a plurality of electrophotographic type image output devices.

One example of a conventional color image output apparatus is shown in FIG. 1. The conventional apparatus is of a tandem type in which a plurality of electrophographic type image output devices or toner image forming units 50*a* through 50*d* are juxtaposedly disposed. The toner image forming units 50*a* through 50*d* are adapted for respectively forming images of different colors of yellow, magenta, cyan and black.

An image receiving or recording medium 64 is disposed below the array of the image forming units 50*a* through 50*d*, and runs in a direction indicated by an arrow in FIG. 1. The yellow toner image forming unit 50*a* is positioned at the most upstream side and the black toner image forming unit 50*d* is positioned at the most downstream side with respect to the running direction of the image recording medium 64. All image forming unit have identical structures with one another except the color of toners contained therein.

The toner image forming unit 50*a* includes a charger 52*a*, an exposure unit 54*a*, a photosensitive drum 56*a*, a developing roller 58*a*, a toner supply roller 60*a* and a toner box 61*a*. The same is true with respect to the other toner image forming units 50*b* through 50*d*. Each photosensitive drum 56*a* through 56*d* is in confrontation with each transfer roller 62*a* through 62*d*, and the image recording medium 64 is adapted to pass through a space between the photosensitive drums 56*a* through 56*d* and the transfer rollers 62*a* through 62*d*. An image fixing unit 66 is disposed downstream of the array of the image forming units.

With this arrangement, in the toner image forming units 50*a* through 50*d*, electrostatic latent images are formed on each photosensitive drums 56*a* through 56*d* by the operation of the chargers 52*a* through 52*d* and the exposure units 54*a* through 54*d*. Further, yellow, magenta, cyan and black toner images are formed respectively on the photosensitive drums by the developing systems including the developing rollers 58*a* through 58*d*, the toner supply rollers 60*a* through 60*d* and the toner boxes 61*a* through 61*d*. These toner images are then transferred onto the image recording medium 64 by the transfer rollers 62*a* through 62*d*, and the resultant color image is fixed by the fixing unit 66.

In the conventional color image output apparatus, mutual positional relationship among the toner image forming units 50*a* through 50*d* must be precisely set, otherwise resultant color or hue is changed, and color unevenness may occur. Distance control between the neighboring image forming units is one example of the position control of the toner image forming units. However, for performing minute or fine distance control, fine or minute displacement mechanisms are required, which are mechanically complicated and costly.

SUMMARY OF THE INVENTION

It is therefore, an object of the present invention to overcome the above described drawback and to provide an improved color image output apparatus capable of facilitating position control to each toner image forming units with a simple arrangement yet providing a resultant color image without color unevenness.

This and other objects of the present invention will be attained by providing an improved color image output apparatus for recording a color image on an image receiving surface of an image receiving medium running in a feeding passage in a feeding direction. The apparatus includes a plurality of single color image forming units arrayed along the feeding passage and each provided with image transfer portion in confrontation with the image receiving surface. The single color image forming units provide single color images of different colors on the image receiving surface, and a combination of the single color images provides a resultant color image. The plurality of single color image forming units are movable independently of each other in a direction across the feeding direction and in a direction capable of facing the image receiving surface. The difference in moving amount of neighboring single color image forming units provides a change in a length of a feeding passage between the image transfer portions of the neighboring single color image forming units.

DETAILED DESCRIPTION OF THE PREFERRED EMBODIMENTS

A color image output apparatus according to one embodiment of the present invention will be described with reference to FIGS. 2 through 5.

The apparatus includes a plurality of electrophographic type toner image forming units 10*a* through 10*d* for respectively forming images of different colors of yellow, magenta, cyan and black. All image forming unit have identical structures with one another except the color of toners contained therein. The yellow toner image forming unit 10*a* includes a charger 12*a*, an exposure unit 14*a*, a photosensitive drum 16*a*, a developing roller 18*a*, a toner supply roller 20*a* and a toner box 21*a*. The same is true with respect to the other toner image forming units 10*b* through 10*d*. Each photosensitive drum 16*a* through 16*d* is in confrontation with each transfer roller 22*a* through 22*d*.

Incidentally, positional relationship among the toner supply roller 20*a*, the developing roller 18*a*, the photosensitive roller 16*a*, and the transfer roller 22*a* is maintained unchanged. These rollers are rotatably supported by a stationary portions of the toner image forming unit 10*a*. The same is true with respect to the rollers of the other toner image forming units 10*b*–10*d*.

Figure 1:
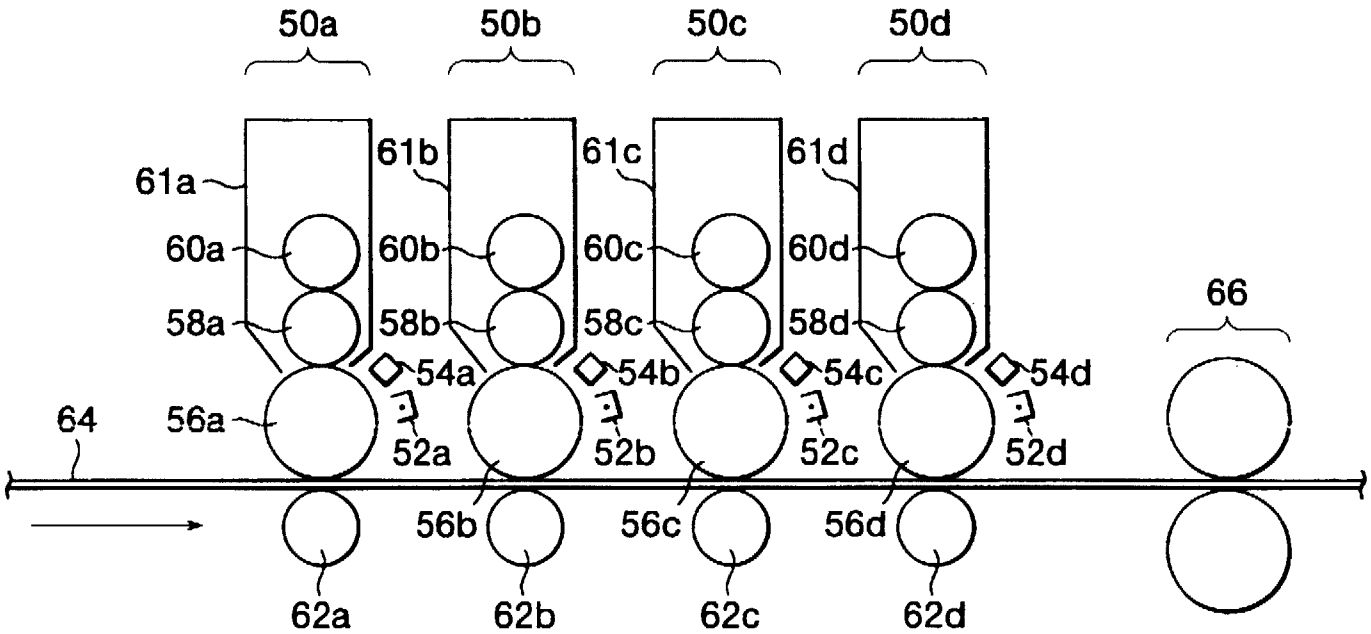
FIG. 1 PRIOR ART
FIG. 1 is a schematic view showing a conventional color image output apparatus of tandem type.
Figure 2:
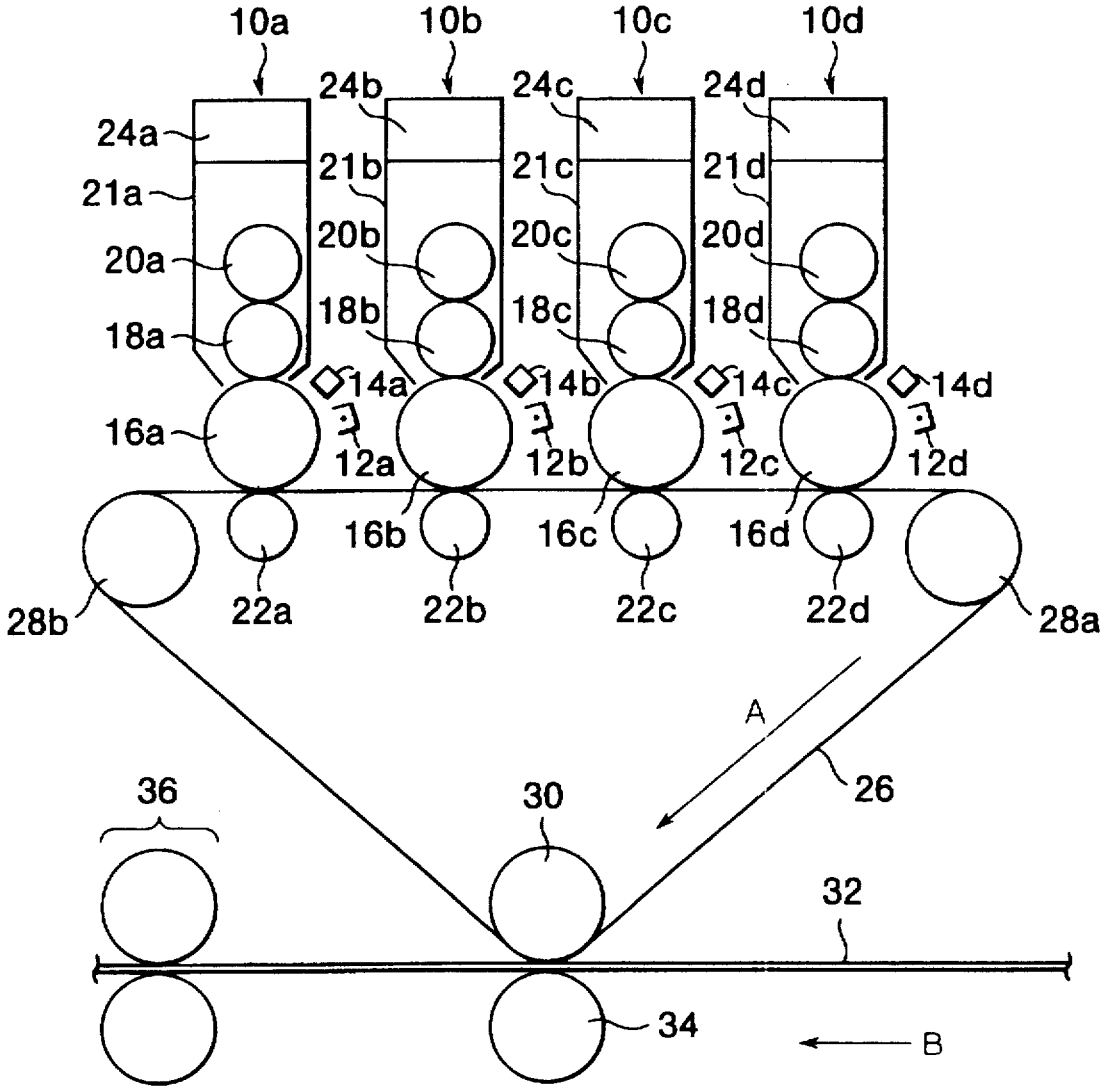
FIG. 2 is a schematic view showing a color image output apparatus according to one embodiment of the present invention.

An intermediate image transfer medium such as an endless belt 26 is disposed below the array of the image forming portions 10*a* through 10*d*, and runs in a direction indicated by an arrow A in FIG. 2. The yellow toner image forming unit 10*a* is positioned at the most upstream side, and the black toner image forming unit 10*d* is positioned at the most downstream side with respect to the running direction of the intermediate image transfer medium or belt 26. Each toner image forming unit 10*a* through 10*d* includes position adjusting unit 24*a* through 24*d* described later.

The intermediate image transfer belt 26 is adapted to pass through a space between the photosensitive drums 16*a* through 16*d* and the transfer rollers 22*a* through 22*d*. A roller 28*b* is rotatably disposed upstream of the transfer roller 22*a*, and a roller 28*a* is rotatably disposed downstream of the transfer roller 22*d* with respect to the running direction of the intermediate image transfer belt 26. Further, a transfer roller 34 is provided, and an auxiliary roller 30 is positioned in confrontation with the transfer roller 34. The endless intermediate image transfer belt 26 is mounted on an outer peripheries of these rollers 28*a*, 28*b* and the auxiliary roller 30 for providing a triangular path. The image transfer belt 26 runs in the direction A by the rotation of these rollers.

An image recording medium 32 such as a paper sheet is provided in confrontation with the endless intermediate image transfer belt 26 at a position between the transfer roller 34 and the auxiliary roller 30. The image transfer belt 26 and the image recording medium 32 is nippingly driven, and the image recording medium 32 runs in the direction indicated by an arrow B by the transfer roller 34 and the auxiliary roller 34 for receiving the color image from the image transfer belt 26. Further, an image fixing unit 36 is disposed downstream of the transfer roller.

The photosensitive drums 16*a*–16*d* are formed of organic photoconductor material, the transfer rollers 22*a*–22*d* and the transfer roller 34 is formed of a rubber material such as urethane rubber, and the intermediate transfer belt is formed of a heat resistant and durable material such as a polyimide.

Next, the position adjusting units 24*a* through 24*d* provided in the toner image forming units 10*a* through 10*d* will be described. Since all position adjusting units 24*a* –24*d* are identical with one another, FIG. 3 show the toner image forming units 10*a* and 10*b* and their position adjusting units 24*a* and 24*b* only.

Figure 3:
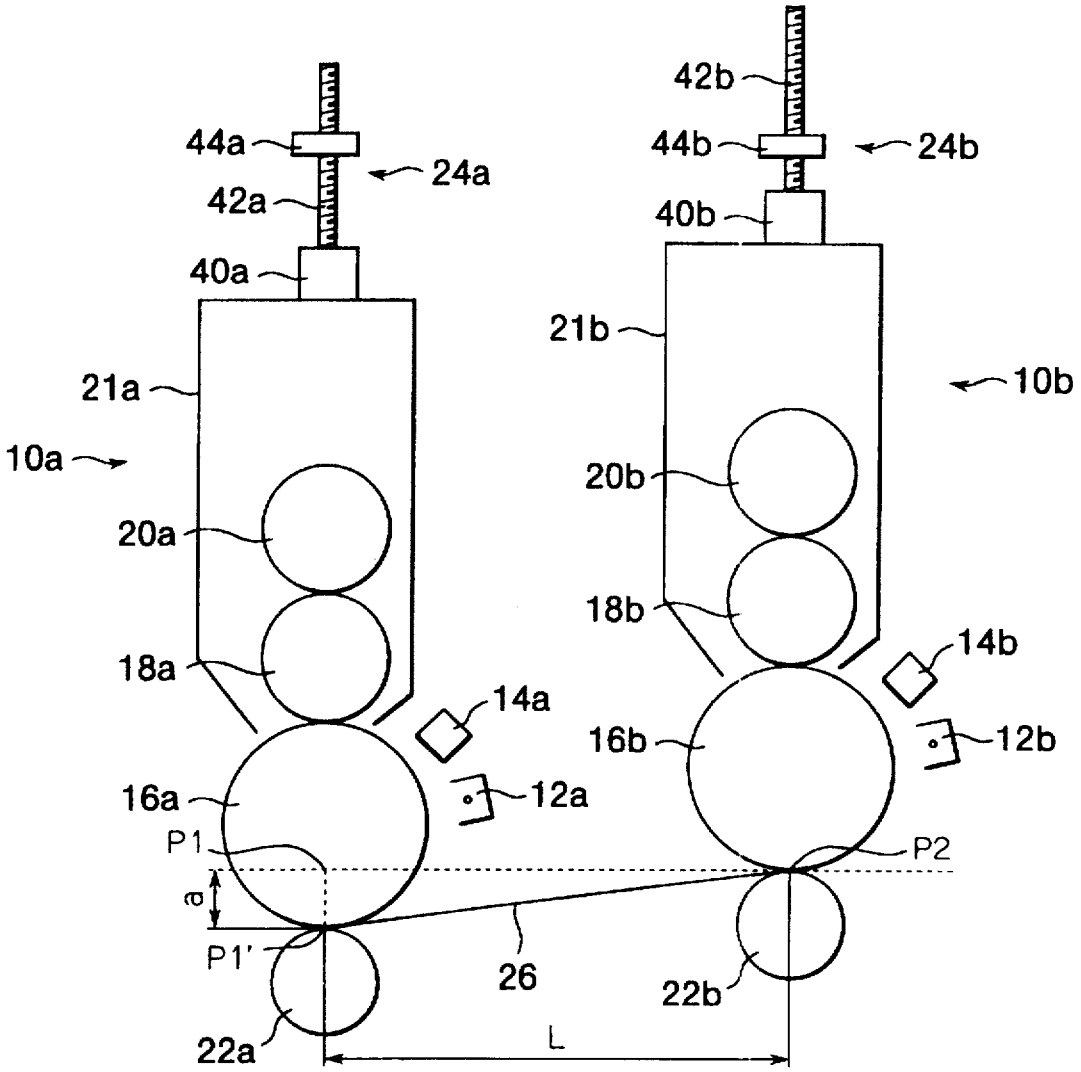
FIG. 3 is a schematic view for description of position control with respect to the neighboring image forming units.
Figure 4:
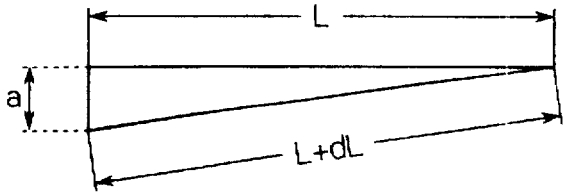
FIG. 4 is a view for description of change of distance between neighboring rollers.
Figure 5:
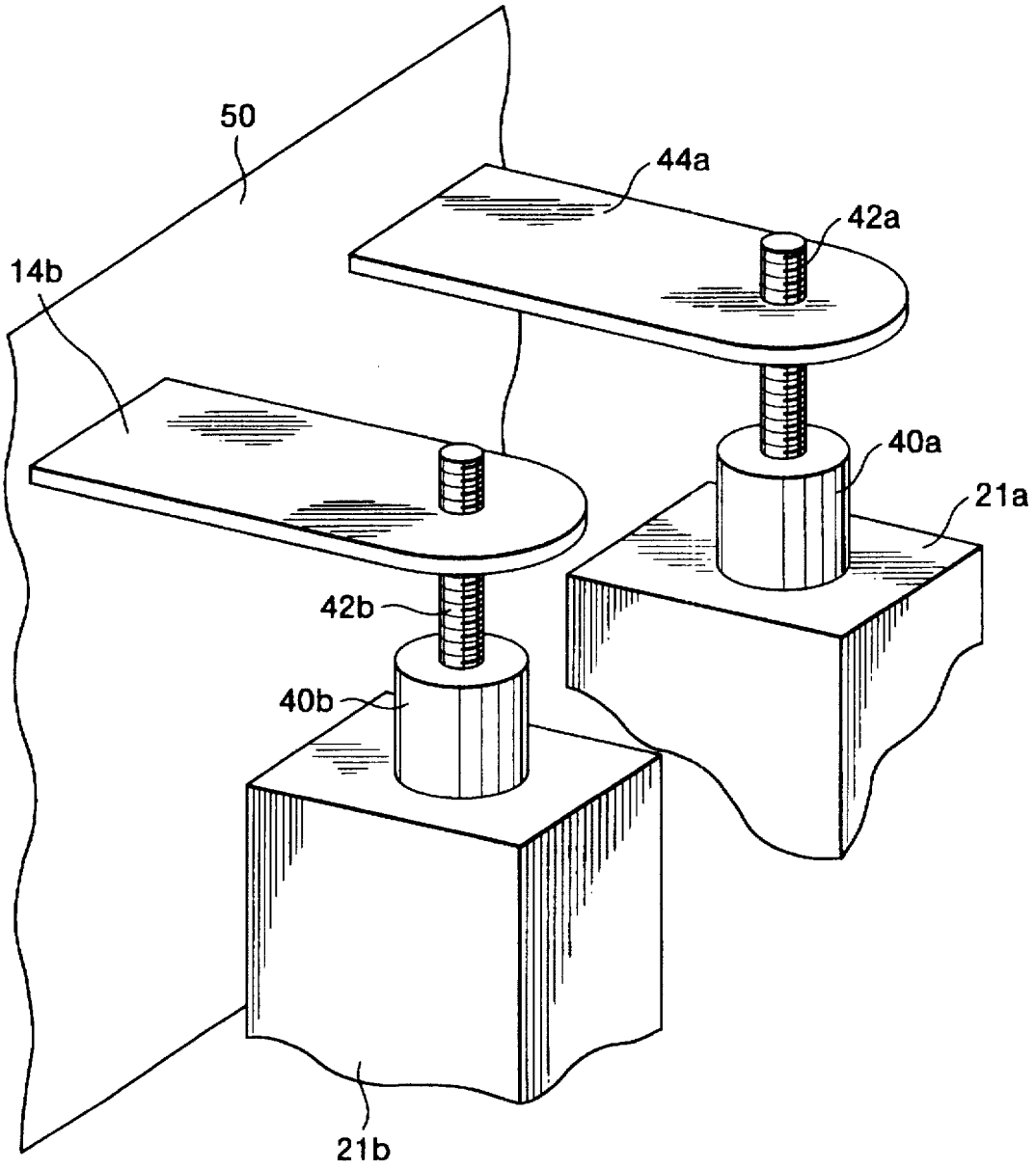
FIG. 5 is a partial perspective view showing supporting arrangement of the neighboring image forming units.

As shown in FIGS. 3 and 5, the position adjusting unit 24*a* includes a drive motor 40*a* fixedly mounted on the toner box 21*a*, a thread 42*a* coupled to a drive shaft of the drive motor 40*a*, and a fixed arm 44*a* fixedly secured to a main frame 50 of the color image output apparatus. The fixed arm 44*a* is formed with a female thread threadingly engageable with the thread 42*a*. Further, a control portion (not shown) is provided for controlling rotation of the drive motor 40*a*.

Upon rotation of the drive motor 40*a*, the thread 42*a* is rotated about its axis, so that the entire toner box 21*a*, i.e., the entire toner forming unit 10*a* is moved in a vertical direction, because of the threading engagement between the thread 42*a* and the stationary female thread of the arm 44*a*. The same is true with respect to the other position adjusting units 24*b*–24*d*. Therefore, each toner image forming unit 10*a* through 10*d* can be moved in the vertical direction independent of one another by the independent rotation of the corresponding motors. That is, each of the toner image forming units 10*a* through 10*d* is movable in a direction across the running direction of the image transfer belt 26, and in a direction capable of facing the image transfer surface of the image transfer belt 26.

With this structure, in the yellow toner forming unit 10*a*, the photosensitive drum 16 is electrically charged by the charger 12*a*, and an electrostatic latent image is formed on the photosensitive drum by the exposure unit 14*a*. The latent image is converted into the toner image by the operation of the developing unit including the developing roller 16*a*, the toner supply roller 20*a*, and the toner box 21*a*. The toner image is then transferred onto the intermediate image transfer belt 26 by the transfer roller 22*a*. The same is true with respect to the transfer of the magenta toner image, cyan toner image and the black toner image onto the intermediate image transfer belt 26 by the transfer rollers 22*b*–22*d*.

A combined resultant color image by the four toner images on the intermediate image transfer belt 26 is then transferred onto the image recording medium 32 by the transfer roller 34 and the auxiliary roller 30, and the color image is then fixed by the fixing unit 36. In this case, each position of each single color image transferred from each photosensitive drum onto the intermediate image transfer belt 26 is very important, and if the position is inaccurate, color unevenness may occur. In the illustrated embodiment, the position adjusting units 24*a* through 24*d* are provided in the image forming units 10*a* through 10*d*, respectively, to facilitate positional adjustment of the respective image forming units in co-operation with the employment of the endless image transfer belt 26.

If positional adjustment is to be performed, for example between the yellow toner image forming unit 10*a* and the magenta toner image forming unit 10*b*, fine positional control can be made.

As shown in FIG. 3, the intermediate image transfer belt 26 is in contact with the photosensitive drums 16*a* and 16*b* at points P1 and P2, where image transfer from the drums 16*a*, 16*b* to the belt 26 are performed by the image transfer rollers 22*a* and 22*b*, respectively. Assuming that an initial distance between the points P1 and P2 is "L" provided that both the yellow toner image forming unit 10*a* and the magenta toner image forming unit 10*b* are positioned at the equal horizontal level as indicated by a broken line in FIG. 3. With this state, by operating only the position adjustment portion 24*a* so that the yellow toner image forming unit 10*a* is moved downwardly by the length "a", the contacting point P1 is shifted to the point P1' accompanying the elastic deformation of the endless intermediate image transfer belt 26. That is, the belt portion 26 initially extending in the horizontal direction as shown by the broken line in FIG. 3 is slanted by the downward movement of the yellow toner image forming unit 10*a*.

Accordingly, the distance between the point P1' and the P2 is increased to (L+dL). Consequently, "dL" means change in distance between the contacting points P1 and P2. This difference is represented by $dL=a^2/2L$.

If "a" is extremely smaller than "L", then, dL is extremely smaller than "a". Therefore, fine or minute distance control can be achieved by the vertical movement of the toner forming unit and by utilizing the elastic deformation of the endless belt 26. This control is much easier than the direct horizontal displacement of the toner image forming unit, in particular, in terms of fine or minute control. In the latter case, it would be difficult to provide a displacing mechanism for horizontally and finely displacing the toner image forming unit. Furthermore, in the latter case, if the horizontal distance between the yellow and magenta toner forming units 50*a* and 50*b* is changed by horizontally shifting the magenta toner forming unit 50*b*, then, the a distance between the magenta toner image forming unit 50*b* and the cyan toner image forming unit 50*c* is also changed, which is disadvantageous.

Thus, in the depicted embodiment, independent position control can be performed, and further, fine or minute distance control is achievable between the image transfer areas by the vertical displacement of the toner image forming unit. By realizing the fine position control, color evenness is provided in the resultant color image.

While the invention has been described in detail and with reference to the specific embodiment thereof, it would be apparent to those skilled in the art that various changes and modifications may be made therein without departing from the spirit and scope of the invention. For example, in the illustrated embodiment, positional control of the toner image forming units 10*a*–10*d* is achieved by the drive motors. However, other driving manner such as manual shifting is available. Further, instead of the electrophotographic type image output method, thermal transfer type color image output method is also available as long as a plurality of color output portions are provided for outputting respective single color image to provide a resultant color image by the combination of the single color images. Furthermore, the present invention is also applied to the color image output apparatus in which the toner image is directly transferred onto the image recording medium without employment of the intermediate image transfer belt as long as the image recording medium is deformable or flexible.

What is claimed is:

1. A color image output apparatus for recording a color image on an image receiving surface of an image receiving medium running in a feeding passage in a feeding direction, the apparatus comprising:

a plurality of single color image forming units arrayed along the feeding passage and each provided with an image transfer portion in confrontation with the image receiving surface, the single color image forming units providing single color images of different colors on the image receiving surface, and a combination of the single color images providing a resultant color image; and, the plurality of single color image forming units being movable independently of each other toward and away from the image receiving medium, difference in moving amount of neighboring single color image forming units providing a change in a length of a feeding passage between the image transfer portions of the neighboring single color image forming units.

2. The color image output apparatus as claimed in claim 1, further comprising a plurality of position adjusting mechanisms each provided for each single color image forming unit for independently changing position of each single color image forming unit in a direction normal to the feeding direction.

3. The color image output apparatus as claimed in claim 2, wherein each of the position adjusting mechanisms comprises means for moving each image transfer portion in a direction normal to the feeding direction of the image recording medium.

4. The color image output apparatus as claimed in claim 3, wherein each of the plurality of single color image forming unit comprises:

a photosensitive drum;

a transfer roller positioned in confrontation with the photosensitive drum, the image receiving medium being passable between the photosensitive drum and the transfer roller, the combination of the photosensitive drum and the transfer roller providing the image transfer portion;

a toner box in which a toner is accumulated, relative positions among the toner box, the photosensitive drum and the transfer roller being maintained unchanged.

5. The color image output apparatus as claimed in claim 4 further comprising a main frame; and wherein each of the position adjusting mechanisms comprises:

a drive motor fixed to the toner box;

a thread coupled to the drive motor and rotatable about is axis by the rotation of the drive motor;

a fixed arm fixed to the main frame and threadingly engageable with the thread, the toner box being movable relative to the main frame.

6. The color image output apparatus as claimed in claim 1, wherein the image receiving medium comprises:

an intermediate transfer medium passing along the feed passage for receiving single color images of different colors from the plurality of the single color image forming units at their image transfer portions, the intermediate transfer medium having the image receiving surface, and an image recording medium positioned in confrontation with the image receiving surface of the intermediate transfer medium for receiving the images from the image receiving surface.

7. The color image output apparatus as claimed in claim 6, further comprising a plurality of position adjusting mechanisms each provided for each single color image forming unit for independently changing position of each single color image forming unit in a direction normal to the feeding direction.

8. The color image output apparatus as claimed in claim 7, wherein each of the position adjusting mechanisms comprises means for moving each image transfer portion in a direction across the feeding direction of the image recording medium.

9. The color image output apparatus as claimed in claim 8, wherein each of the plurality of single color image forming unit comprises:

a photosensitive drum;

a transfer roller positioned in confrontation with the photosensitive drum, the intermediate image transfer medium being passable between the photosensitive drum and the transfer roller, the combination of the photosensitive drum and the transfer roller providing the image transfer portion;

a toner box in which a toner is accumulated, relative positions among the toner box, the photosensitive drum and the transfer roller being maintained unchanged.

10. The color image output apparatus as claimed in claim 9 further comprising a main frame; and wherein each of the position adjusting mechanisms comprises:

a drive motor fixedly provided on the toner box;

a thread coupled to the drive motor and rotatable about is axis by the rotation of the drive motor;

a fixed arm fixed to the main frame and threadingly engageable with the thread, the toner box being movable relative to the main frame.

11. The color image output apparatus as claimed in claim 10, wherein the intermediate transfer medium is formed of an elastic material.

12. The color image output apparatus as claimed in claim 11, wherein the elastic material is polyimide.

13. The color image output apparatus as claimed in claim 12, wherein the intermediate transfer medium comprises an endless belt.

14. The color image output apparatus as claimed in claim 13, further comprising:

a first roller rotatably disposed at upstream of an array of the plurality of single color image forming units;

a second roller rotatably disposed downstream of the array of the plurality of single color image forming units, an auxiliary roller for defining a triangular path of the intermediate transfer medium in co-operation with the first and second rollers; and an image transfer roller positioned in confrontation with the auxiliary roller for transferring the color image carried on the intermediate transfer medium to the image recording medium.

15. The color image output apparatus as claimed in claim 1, wherein the color image output apparatus includes only a single image receiving medium.

16. The color image output apparatus as claimed in claim 1, wherein each single color image forming unit is movable in a direction substantially normal to the feeding direction.

* * * * *